US009650579B2

(12) United States Patent
Fanget et al.

(10) Patent No.: US 9,650,579 B2
(45) Date of Patent: May 16, 2017

(54) PROCESS FOR PRODUCTION OF LIGHT OLEFINS AND BTX USING AN FCC UNIT PROCESSING A HEAVY FEEDSTOCK OF THE HIGHLY HYDROTREATED VGO TYPE, COUPLED WITH A CATALYTIC REFORMING UNIT AND AN AROMATIC COMPLEX PROCESSING A NAPHTHA-TYPE FEEDSTOCK

(71) Applicant: IFP Energies nouvelles, Rueil-Malmaison (FR)

(72) Inventors: Bertrand Fanget, Vienne (FR); Abdelhakim Koudil, Lyons (FR); Alexandre Pagot, St Genis Laval (FR); Romain Corroyer, Grigny (FR); Joana Fernandes, Solaize (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 139 days.

(21) Appl. No.: 14/680,542

(22) Filed: Apr. 7, 2015

(65) Prior Publication Data

US 2015/0284644 A1 Oct. 8, 2015

(30) Foreign Application Priority Data

Apr. 7, 2014 (FR) ..... 14 53075

(51) Int. Cl.

| | |
|---|---|
| ***C10G 63/04*** | (2006.01) |
| ***C10G 11/18*** | (2006.01) |
| ***C10G 69/04*** | (2006.01) |
| ***C10G 35/00*** | (2006.01) |

(Continued)

(52) U.S. Cl.

CPC ..... *C10G 63/04* (2013.01); *C10G 11/18* (2013.01); *C10G 11/182* (2013.01); *C10G 35/00* (2013.01); *C10G 69/04* (2013.01); *C10G 69/08* (2013.01); *C10G 69/126* (2013.01); *C10G 2300/1044* (2013.01); *C10G 2300/1059* (2013.01); *C10G 2300/1074* (2013.01); *C10G 2300/1077* (2013.01); *C10G 2400/20* (2013.01); *C10G 2400/30* (2013.01)

(58) Field of Classification Search

None

See application file for complete search history.

(56) References Cited

U.S. PATENT DOCUMENTS

| | | | |
|---|---|---|---|
| 5,685,972 | A | 11/1997 | Timken et al. |
| 2008/0156696 | A1 | 7/2008 | Niccum et al. |

(Continued)

OTHER PUBLICATIONS

Search Report dated Jan. 26, 2015 issued in corresponding application FR 1453075 (pp. 1-2).

*Primary Examiner* — Tam M Nguyen

(74) *Attorney, Agent, or Firm* — Millen, White, Zelano, Branigan, P.C.

(57) ABSTRACT

The present invention relates to the FCC units processing heavy feedstocks enriched with hydrogen, such as for example a highly hydrotreated VGO, or the unconverted part at the end of hydrocracking this same type of VGO feedstock, feedstocks which have the characteristic of cracking to light olefins such as ethylene and propylene. The integration of an FCC with an aromatic complex allows the recovery by the aromatic complex of the BTX formed in the FCC, and the recovery by the FCC from the flow at the bottom of the column, of heavy aromatics from the aromatic complex.

12 Claims, 3 Drawing Sheets

(51) Int. Cl.
*C10G 69/08* (2006.01)
*C10G 69/12* (2006.01)

(56) References Cited

U.S. PATENT DOCUMENTS

2008/0223754 A1 9/2008 Subramanian et al.
2008/0264829 A1 10/2008 Eng et al.

PROCESS FOR PRODUCTION OF LIGHT OLEFINS AND BTX USING AN FCC UNIT PROCESSING A HEAVY FEEDSTOCK OF THE HIGHLY HYDROTREATED VGO TYPE, COUPLED WITH A CATALYTIC REFORMING UNIT AND AN AROMATIC COMPLEX PROCESSING A NAPHTHA-TYPE FEEDSTOCK

FIELD OF THE INVENTION

The invention relates to the field of refining processes and petrochemicals and achieves an advanced integration between the FCC unit and the aromatic complex (CA). The present invention relates more particularly to the case of FCC units processing feedstocks that are heavy but severely hydrotreated, therefore having a hydrogen content greater than 13.5% by weight. During catalytic cracking, these feedstocks have a coke deficit, which adversely affects the heat balance of the FCC.

The present invention describes means making it possible to re-establish a heat balance equilibrium by exchange of material flows between the FCC and the aromatic complex (CA).

EXAMINATION OF THE PRIOR ART

It is known from the prior art that the cracking of highly hydrogenated cuts in the FCC processes poses certain thermal balancing problems linked to the fact that these feedstocks are not good coke precursors, which means that the heat balance of these units can be achieved only by supplying external heat to the process. It is common to find inventions which propose burning, in the regenerator, of very heavy carbon-rich feedstocks of the "torch oil" type.

Other inventions describe recycling a coking cut into the stripper or into a stripper bypass storage. The present invention proposes recycling a coking cut originating from the aromatic complex, to the FCC unit.

This cut originating from the aromatic complex (CA) is recycled to the FCC reactor which can operate equally well with an upward flow ("riser") and with a downward flow ("downer"), and its conversion allows an increase in the BTX yield in addition to improvement in the heat balance of the FCC unit.

In practice, a person skilled in the art does not link together in sequence, processes allowing the recovery of the BTX formed in the FCC units, as these molecules with high added values are immersed in effluents from which it is difficult to extract them at low cost. The integration of the FCC with the aromatic complex proposes recycling the light cracked naphtha cut, referred to as the "LCN" cut, formed in the FCC, towards the aromatic complex (CA) in order to extract the aromatics of commercial interest.

The prior art also proposes recycling FCC effluents into an additional reactor in order to exhaust the potential of these unconverted cuts such as the C4 cut for example.

The present invention, taking advantage of the immediate proximity of the FCC and the aromatic complex, proposes in addition to conventional recycling of products originating from the FCC, the recycling of the flow of heavy aromatics originating from the aromatic complex originally dedicated to the gasoline pool.

Moreover, the present invention also describes the possibility of preheating the FCC feedstock by recovery of the heat from the furnaces of the catalytic reforming units. The present invention thus proposes recovering part of the heat available in the convection zones of the furnaces for preheating the catalytic reforming feedstock, with the aim of preheating the FCC feedstock.

BRIEF DESCRIPTION OF THE INVENTION

Figure 1:
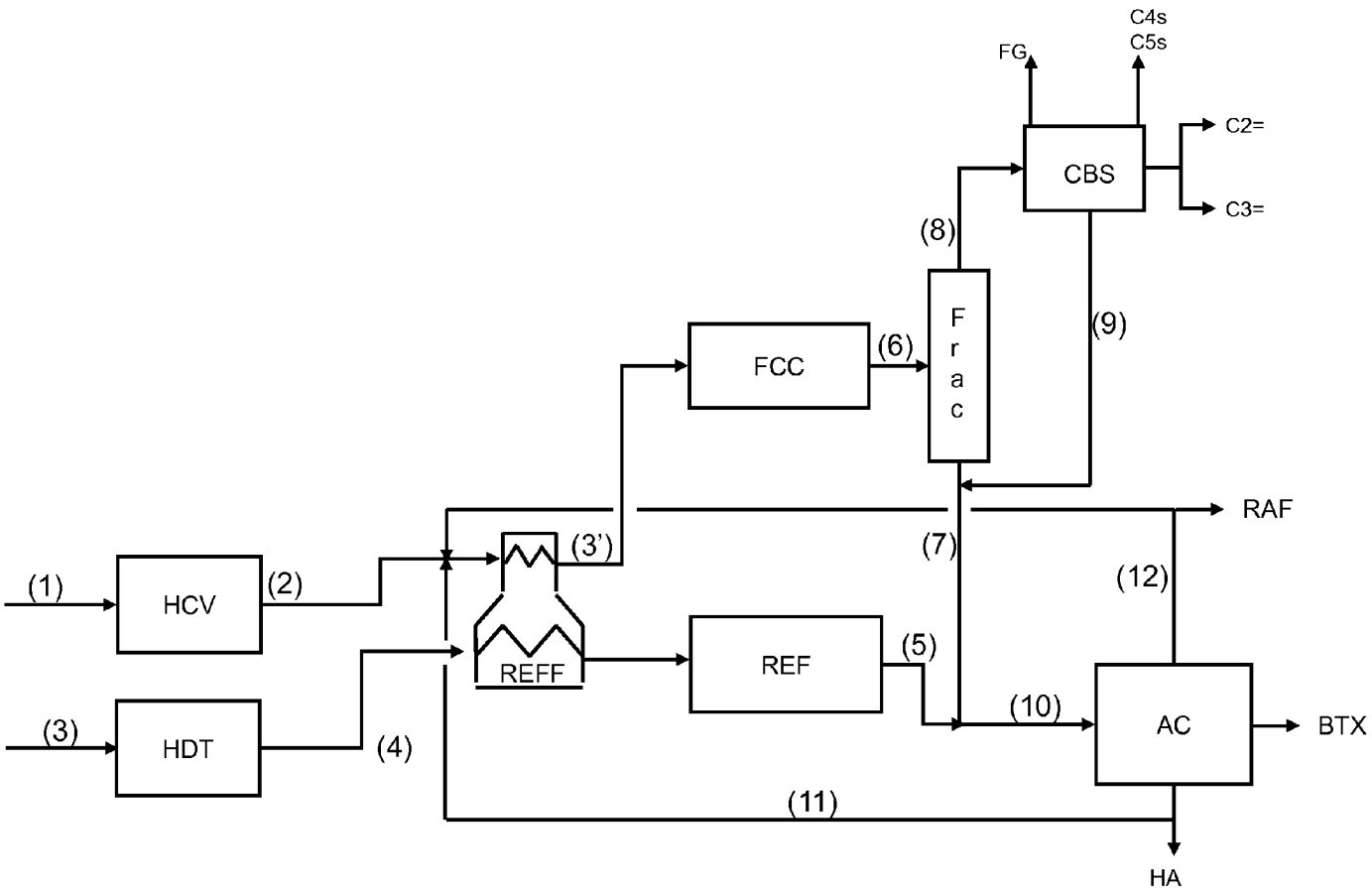
FIG. 1 shows a diagram of the process according to the present invention in its basic version. The following abbreviations have been used to denote the main units: HCV for hydroconversion, HDT for hydrotreatment, FCC for catalytic cracking, CR for catalytic reforming of gasoline, AC for the aromatic complex.

The present invention can be defined as a process for the production of C2, C3 and C4 light olefins and BTX (benzene, toluene, xylenes) using a catalytic cracking (FCC) unit and an aromatic complex (CA) including a unit for the catalytic reforming (CR) of gasoline.

These three units operate in synergy in the sense that they exchange flows of both material and heat.

The feedstock referred to as LCN, originating from the catalytic cracking (FCC) unit is defined by its distillation range (IP-160° C.), IP (initial distillation point) being able to vary from 30° C. to 60° C., and FP (final distillation point) being defined within 10° C. more or less, i.e. being able to vary from 150° C. to 170° C.

This definition of the LCN cut remains valid throughout the present text. For the sake of simplicity it will continue to be denoted IP-160° C.

The LCN feedstock is introduced in a mixture with the feedstock (5) of the aromatic complex (CA).

The feedstock referred to as heavy aromatics (11) produced by the aromatic complex (CA), is composed of aromatics with more than 10 carbon atoms. This heavy aromatics feedstock is sent in a mixture with the feedstock (2) for the FCC unit where, by means of its coking power it provides the calories necessary to achieve heat balance.

Finally the feedstock (2) of the FCC unit is preheated in the furnaces of the catalytic reforming (CR) unit, preferably in the convection zones thereof.

More precisely the present invention can be defined as a process for the production of light olefins and BTX from a first feedstock of the hydrotreated VGO or unconverted oil (UCO) type resulting from a hydroconversion process, or any mixture of these two feedstocks, and a second naphtha-type feedstock, with an initial boiling point greater than 30° C. and final boiling point less than 220° C., said process comprising a catalytic cracking (FCC) unit processing the hydrotreated VGO or the unconverted oil (UCO) feedstock, a catalytic reforming (CR) unit processing the feedstock referred to as naphtha (30° C.-220° C.), and an aromatic complex (CA) fed by the catalytic reforming (CR) effluents, and the fraction referred to as LCN (IP-160° C.) of the FCC effluents, said process comprising the following sequence of operations:

- The hydrotreated VGO or the unconverted oil UCO feedstock (2), or any mixture of the two feedstocks, is sent into an FCC unit which produces effluents (6) which are sent into a fractionation (FRAC) unit, from which a light fraction (8), an LCN cut (IP-160° C.), an HCN cut (160° C.-220° C.), and a heavy fraction (220° C.+) are extracted,
- The light fraction (8) is sent into a separation box, referred to as a cold box (SBF), making it possible to separate the light olefins, ethylene and propylene, the dry gases (H2 and CH4), and the C2, C3 and C4 light paraffins,
- The gasoline cut referred to as LCN (IP-160° C.) (9), is sent to the aromatic complex (CA) in a mixture with the catalytic reforming (CR) effluents (5), in order to form the feedstock (10) for the aromatic complex (CA),
- the HCN cut (160° C.-220° C.) is upcycled as it is,
- the heavy fraction (220° C.+) with an initial boiling point greater than 220° C. which in this case has a significant cracking potential, is recycled to the FCC
- The hydrotreated naphtha (4) is sent as feedstock for the catalytic reforming (REF) unit,
- The following are extracted from the aromatic complex (CA): the BTXs, a raffinate (12) defined as the non-aromatic part of the effluents, which is sent at least partially in a mixture with the FCC feedstock (2), and a fraction referred to as heavy aromatics (11) which is also sent in a mixture with the FCC feedstock (2).

According to a first variant of the process of the present invention, the raffinate effluent (12) from the aromatic complex is sent into a separation unit (SPLIT) which makes it possible to separate a light fraction (13) which is sent in a mixture with the feedstock (2) to the catalytic cracking (FCC) unit, and a heavy fraction (14) which is sent in a mixture with the hydrotreated naphtha feedstock (4) to the catalytic reforming (REF) unit.

According to a second variant of the process according to the invention, the C4 and C5 light olefins originating from the separation box (SBF), denoted flow 15, are sent into an oligomerization (OLG) unit, and the effluents (16) from said oligomerization unit (15) are sent in a mixture with the feedstock (2) into the catalytic cracking (FCC) unit.

According to a third variant of the process according to the invention, the feedstock for the FCC unit (2) is preheated in the convection zones of the catalytic reforming furnaces (FREF) before being introduced as feedstock for the catalytic cracking (FCC) unit.

Finally the advantages which are provided by the present invention can be summarized in the following points:

The FCC allows the production of a flow which can be upcycled to BTX in the aromatic complex.

The flow rates of light olefins produced by the FCC are increased.

The flow rates of aromatics which can be upcycled to petrochemicals originating from the aromatic complex (BTX) are increased.

The FCC benefits from a subsequent supply of coke thanks to the recycling of at least part of the heavy aromatics cut originating from the aromatic complex, which makes it possible to achieve the heat balance.

The integration of the aromatic complex and the FCC makes it possible to obtain a process layout which optimizes and renders flexible the production and recovery of the compounds with a high added value, such as the light olefins and the BTX.

The flow of heavy aromatics originating from the aromatic complex (11) is minimized, or even eliminated, to the benefit of coke produced and necessary for the heat balance of the FCC, and BTX produced by cracking in the FCC.

The FCC feedstock can be preheated by the furnaces of the catalytic reforming unit, which makes it possible to further improve the heat balance of the FCC.

DETAILED DESCRIPTION OF THE INVENTION

An FCC unit generally processes a heavy cut originating from the vacuum distillation unit, such as VGO (abbreviation for "vacuum gas oil"), or also an atmospheric residue alone or in a mixture. However, sometimes the feedstock arriving at the FCC, for example a VGO, may be significantly lighter due to a pretreatment carried out beforehand, generally a more or less severe hydrotreatment, or due to its originating from a conversion unit in which the initial feedstock is highly enriched with hydrogen.

Such a feedstock, due to its high hydrogen content (greater than 13.5% by weight of the feedstock), has a high light olefins potential especially in terms of propylene (C3=), butenes (C4=), but also ethylene (C2=).

This feedstock also has the advantage of having a low content of nitrogen- and sulphur-containing impurities, which leads to an LCN cut (abbreviation of "light cracked naphtha") originating from the catalytic cracking, which can be oriented towards the inlet of the aromatic complex generally in a mixture with an ex-reforming feedstock.

This LCN feedstock can optionally be mixed with a feedstock of the steam cracker gasoline type in order to be hydrotreated before going to the aromatic complex.

The cracking reactions in the FCC also lead to the production of aromatic compounds and in particular compounds with a high added value such as benzene, toluene and xylene (in particular para-xylene), generally denoted BTX, that it will be possible to upcycle in the FCC-Aromatic Complex sequence.

The flexibility of the FCC additionally makes it possible to process feedstocks that are secondary to the main feedstock.

These secondary feedstocks generally represent less than 10% by weight of the main feedstock and are recycled from available effluents, effluents which have a significant light olefins potential. This is the case in particular with the flow referred to as "raffinate" originating from the aromatic complex, which is a flow with a low content of aromatic compounds.

In the context of the present invention, i.e. the proximity of the FCC unit and the aromatic complex (CA), it is easy to recycle the "raffinate" flow to the FCC unit as secondary feedstock.

The heaviest effluents originating from the aromatic complex (CA), generally aromatics with 10 or more carbon atoms, have the advantage of being highly coking during catalytic cracking.

Recycling this type of highly coking feedstock to the FCC makes it possible to benefit from an additional source of coke, and therefore to achieve equilibrium of the heat balance with a coke deficit originating from a main feedstock enriched with hydrogen and, at the same time, to be able to increase the BTX yield of the aromatic complex.

FIG. 1 represents a diagram of the sequence according to the present invention.

The feedstock entering the hydroconversion (HCV) unit is a heavy feedstock generally originating from a vacuum distillation.

This is most often a vacuum distillate, denoted VGO, the initial boiling point of which is generally greater than 340° C., and the final point of which can be variable, but is generally less than 700° C.

It is possible for example to have a light vacuum distillate (LVGO) or a heavy vacuum distillate HVGO, depending on the intermediate cut point adopted. On leaving the conversion unit (HCV), the unconverted part, i.e. the part referred to as 340 C+, (denoted UCO) is found to have been purified, with a very low sulphur and nitrogen content compared to the original feedstock, but above all, it is substantially enriched with hydrogen, reaching contents above 13.5% with relatively low residual carbon, less than 0.5%.

All or part of this unconverted oil is sent to the FCC catalytic cracking unit.

In summary, the feedstock entering the FCC can be any mixture of hydrotreated VGO feedstock and UCO feedstock within the meaning previously defined.

The naphtha feedstock going to the hydrotreatment (HDT) unit is a gasoline cut, the initial boiling point of which is generally greater than 30° C. and the final boiling point of which is generally less than 220° C. It is processed in a hydrotreatment unit in order to remove the sulphur-containing compounds, so as to reach an S content of less than 0.5 ppm.

The desulphurized gasoline effluent (30-220° C.) is sent to the catalytic reforming (CR) unit after being heated in an exchange train comprising furnaces.

The desaturation of the molecules produces hydrogen which is accompanied by an enrichment of the gasoline fraction with aromatics. This aromatics-rich fraction is then sent to the aromatic complex (CA) for the extraction/production of aromatics in particular benzene, toluene and xylenes (BTX).

FIG. 1 shows how the FCC is connected to the reforming (CR)-aromatic complex (CA) assembly by two flows:

- a first flow being constituted by the effluent referred to as LCN (IP-160° C.) originating from the FCC, which is sent to the aromatic complex, in a mixture with the main feedstock for said aromatic complex (CA).
- a second flow is constituted by the heavy aromatics effluent originating from the aromatic complex, which can be defined as all of the molecules with more than 10 carbon atoms and which is sent to the FCC in a mixture with the feedstock for said FCC.

Another factor relating to the integration of the FCC with the aromatic complex is achieved by the use of the reforming furnaces as a means for preheating the feedstock for said FCC, preferably in the convection zones of these furnaces which generally correspond to approximately 25%-35% of the total heating power. This preheating contributes to the achievement of the heat balance of the FCC, which has a coke deficit due to its highly hydrogenated feedstock.

The flow of heavy aromatics originating from the aromatic complex (CA) is recycled to the FCC, not by burning it in the regenerator, but by processing it in a mixture with the feedstock in the FCC reactor. Thus this flow of heavy aromatics (11) will be converted, producing BTX aromatics and additional coke (with respect to the highly hydrogenated feedstock) making it possible to achieve the overall heat balance of the FCC unit.

For an improved production of light olefins in the FCC, the raffinate originating from the aromatic complex is recycled to the riser so as to crack it to produce mainly propylene, butenes and ethylene.

Conversely, the FCC contributes to a greater production of BTX aromatics, as the light cracked gasoline part, referred to as LCN, which is virtually free of sulphur and other impurities due to the stage of hydroconversion of the heavy feedstock, is sent to the aromatic complex (CA) in order to carry out the extraction and conversion of the aromatics for the maximum production of benzene, toluene and para-xylene.

This implementation between the two complexes allows very significant synergies.

Figure 2:
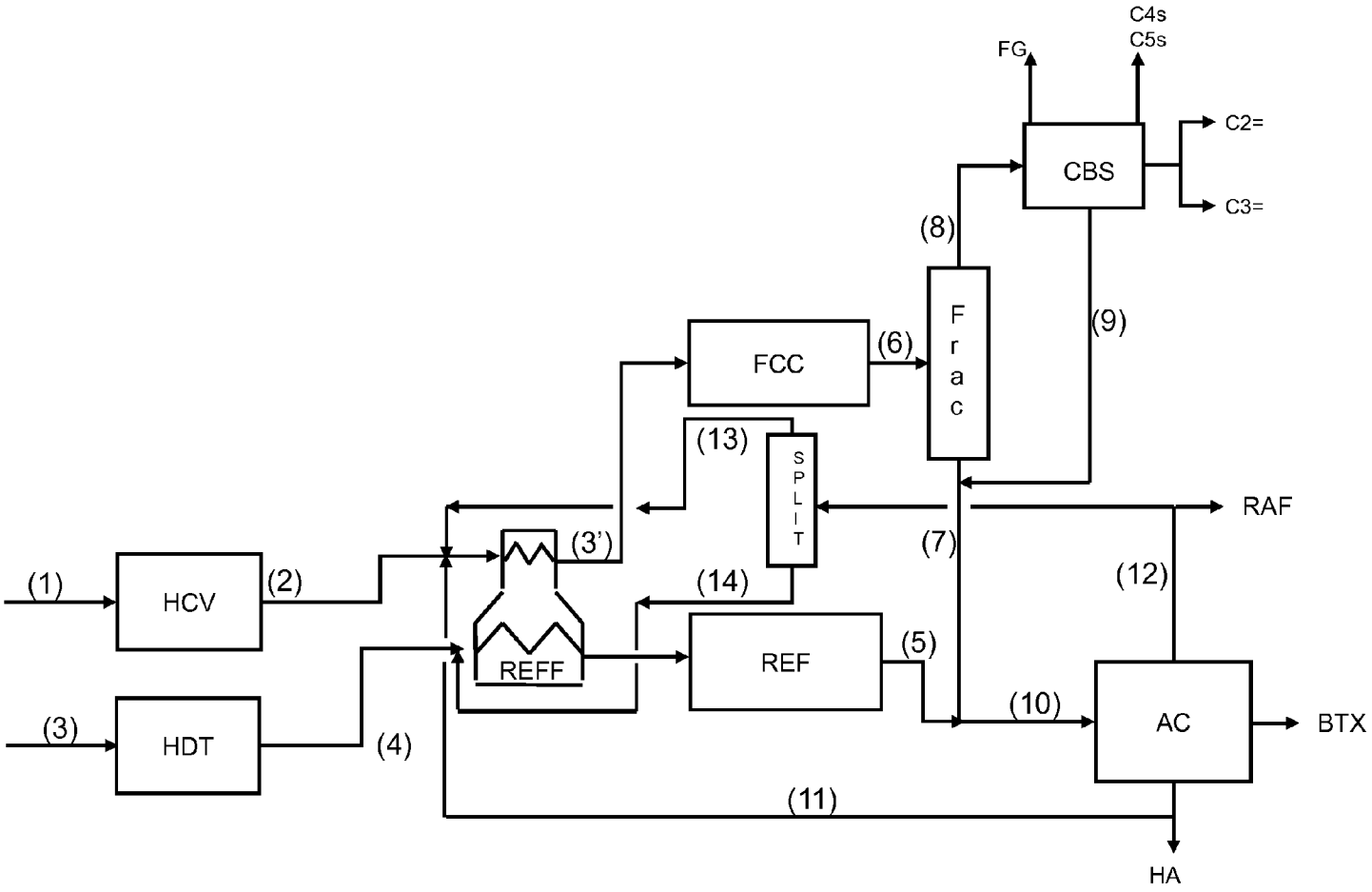
FIG. 2 shows a first variant of the basic diagram in which the flow of raffinate originating from the aromatic complex is divided into two flows, a light flow which is sent in a mixture with the FCC feedstock and a heavy flow which is sent in a mixture with the feedstock for the catalytic reforming of gasolines.

FIG. 2 shows a variant of the present invention in which the raffinate originating from the aromatic complex is divided into two; the light part going to the FCC, while the heavy part is recycled to the aromatic complex. Furthermore, it may be desired to extract even more upgradable aromatics from the assembly by sending the heavy cracked gasoline HCN into the starting naphtha flow, so that said HCN feedstock undergoes a hydrotreatment before re-entering the aromatic complex (CA).

The heavy fraction originating from the FCC fractionation can preferably be recycled in whole or in part to the FCC reactor in order to produce even more olefins and aromatics, as well as for the production of additional coke which is essential to the heat balance of the FCC unit.

Figure 3:
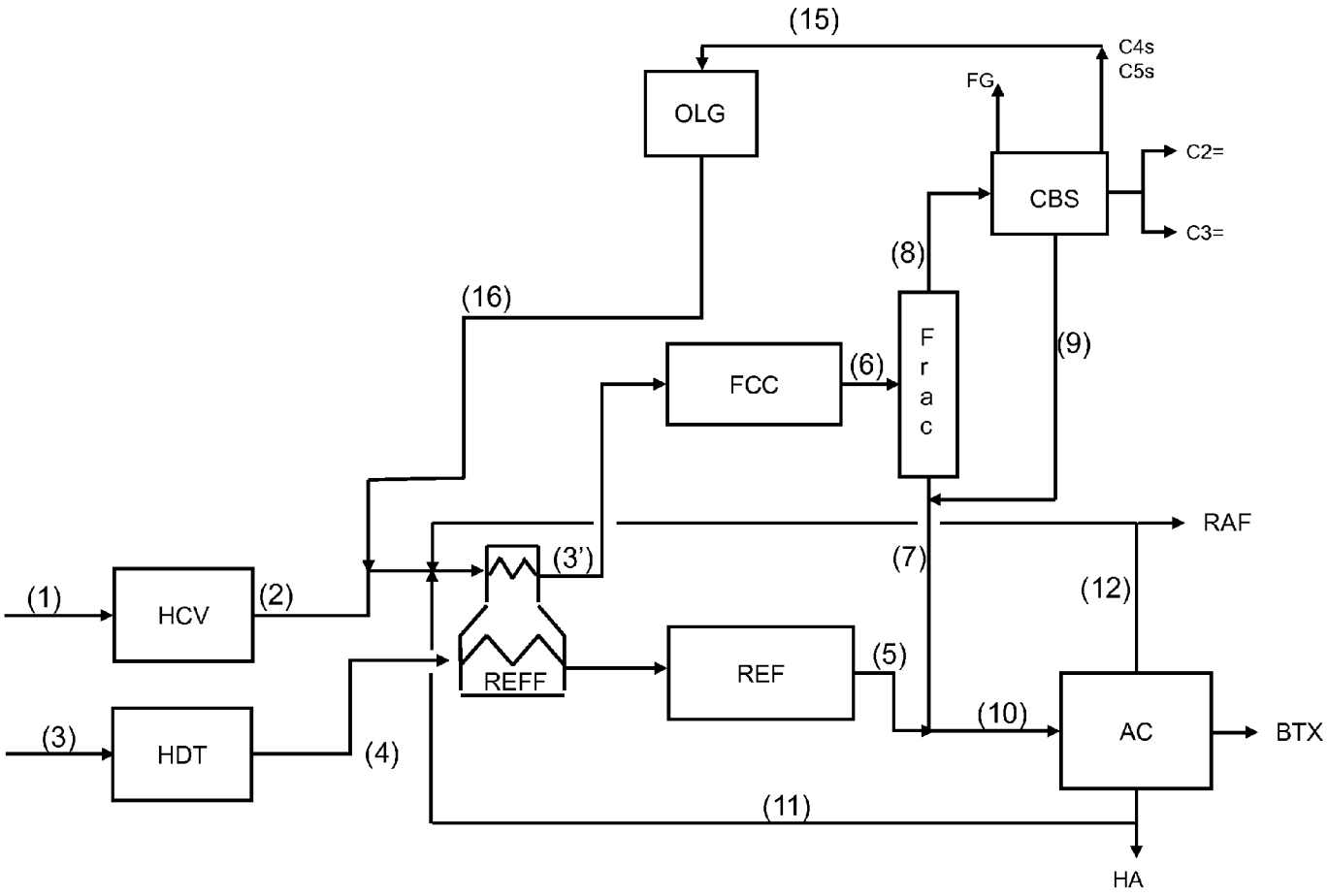
FIG. 3 shows a second variant of the basic diagram in which a flow composed mostly of C4 and C5 olefins is isolated at the cold-box separation (CBS) section downstream of the FCC in order to be sent into an oligomerization (OLG) unit which makes it possible to produce longer olefins feeding the FCC unit in a mixture with the main feedstock.

FIG. 3 shows another variant of the present invention which consists of separating, starting from the C5 cut leaving the FCC reactor, so as to send into the cold box a part comprising the dry gases, the LPGs as well as the compounds with five carbon atoms in order to be further separated and thus make it possible to isolate the C4 and C5 fraction in order to recycle it into the reaction section of the FCC or to send it into an oligomerization (OLG) unit in order to then send the thus-formed oligomerate into the FCC reactor, which increases the light olefin yields.

Of course the variants of FIGS. 2 and 3 can perfectly well be implemented separately or be combined.

In addition to the main reactor processing the highly hydrogenated feedstock, the FCC can optionally be equipped with another reactor referred to as secondary, dedicated to various light cuts the cracking conditions of which can be more severe.

Characteristics of the Flows of the FCC+AC Complex

The first feedstock (1) entering the FCC-Petrochemicals unit is an unconverted oil originating from a VGO hydrocracking unit or a severely hydrotreated VGO.

Table 1 gives the ranges of properties for a feedstock of such a type.

TABLE 1

Characteristics of the main FCC feedstock

| | | Type of feedstock | Min/Max |
|---|---|---|---|
| Nitrogen-containing compounds | mg/kg | 7.84 | 1-50 |
| Conradson Carbon | | <0.2% | <1 |
| IP (0.50%) | ° C. | 244.1 | >240 |
| FP (99.50%) | ° C. | 649.4 | <700 |
| Hydrogen (NMR) | % m/m | 14.2 | 13.5-14.5 |
| SPGR 15° C. | kg/m3 | 844.8 | 800-920 |
| Saturates | % m/m | 92.1 | 85-98 |
| Aromatics | % m/m | 4.9 | 2-10 |
| Resins | % m/m | 0.7 | <5 |
| Vanadium (FX) | mg/kg | <2 | <5 |
| Nickel (FX) | mg/kg | <2 | <5 |
| Sulphur (FX) | ppm | 54.6 | <100 |

The flow of light cracked gasoline (9) denoted LCN, originating from the FCC is recycled to the aromatic complex (CA). This is a depentanized cut, the initial boiling point (IP) of which is greater than 30° C.

The final boiling point (FP) is generally 160° C.

The flow of heavy cracked gasoline denoted HCN originating from the FCC is generally richer in aromatics than the LCN fraction, with an initial point (IP) corresponding to the final cut point of the LCN and a final cut point (FP) generally not exceeding 220° C.

This HCN cut is often richer in sulphur than the light fraction of the FCC gasoline. Under severe cracking conditions, its yield is low, but it concentrates the sulphur-containing compounds of the total FCC gasoline.

The flow of heavy fraction (16) originating from the fractionation of the liquid effluents from the FCC is a hydrocarbon cut, the initial boiling point of which (IP) is 220° C. This flow concentrates the major proportion of the sulphur- and nitrogen-containing compounds initially present in the feedstock, and can be recycled in whole or in part to the FCC reactor.

The flow of heavy aromatics (11) originating from the aromatic complex and recycled to the FCC reactor is composed mostly of aromatic compounds of which the carbon number is greater than or equal to 10.

The initial distillation temperature (IP) of this flow (11) is generally greater than 190° C.

The flow of raffinate (12) originating from the aromatic complex is a cut virtually free of aromatic compounds. The initial boiling point (IP) of this cut is greater than 30° C., and its final boiling point (FP) is variable, but is normally comprised between 150° C. and 220° C. The flow of raffinate (12) can optionally be cut into two fractions with an intermediate point comprised between 75° C. and 150° C.

Operating Conditions of the FCC Unit

The FCC unit is a unit for the catalytic cracking of highly hydrotreated VGO or of unconverted oil originating from units for the hydroconversion of VGO. The FCC unit in the context of the present invention has at least one main reactor operating either with an upward flow ("riser"), or with a downward flow ("downer").

The FCC unit has a separator-stripper section in which the catalyst is separated from the hydrocarbon-containing effluents.

The FCC unit also has a section for regeneration of the catalyst in which the coke formed during the reaction and deposited on the catalyst is burnt in a flow of air generating combustion fumes and making it possible to recover the major proportion of the heat necessary to the reactor in the form of sensible heat from the catalyst itself.

The FCC unit has its own section for treatment of the hydrocarbon-containing effluents with, in particular, a gas plant allowing a separation of the light olefins (ethylene, propylene, butenes) from the other gases: hydrogen, methane, ethane, propane.

The heavier proportion of the hydrocarbon effluents is processed in a separation section comprising at least one fractionation (FRAC) unit making it possible to recover the typical distillation range cut [30° C.-160° C.], the cut referred to as LCN, which is recycled to the aromatic complex (CA).

The intermediate part comprising the hydrocarbons with 4 and 5 carbon atoms can be either recycled directly to the FCC or preferably sent to an oligomerization unit in order to obtain a poly C4/C5 oligomerate the crackability of which in the catalytic cracking processes is much greater than that of the non-oligomerized compounds, or be upcycled to their dedicated pool.

The FCC unit is preferably operated at high severity (high riser outlet temperature; high catalyst to feedstock: C/O ratio). The range of operating conditions is given in Table 2 below.

TABLE 2

Range of the operating conditions of the FCC unit

| Condition | Min | Max |
|---|---|---|
| ROT, ° C. | 500 | 650 |
| C/O, kg/kg | 5 | 30 |

The catalyst can be any type of catalyst preferably containing a high proportion of zeolite. It can be a usual FCC catalyst. It may or may not contain added ZSM-5, or even be composed 100% of ZSM-5.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding application No. FR 14/53.075, filed Apr. 7, 2014 are incorporated by reference herein.

EXAMPLES

Laboratory tests with commercial FCC catalysts with or without additives of the ZSM-5 type were carried out in order to validate the results of the present invention. The tests were carried out under conditions of high severity for simulation of the FCC unit: ROT=605° C.±5° C. and C/O=15±1 kg/kg.

Example 1

Cracking of a Severely Hydrogenated Heavy Feedstock (Not According to the Invention)

This example shows the separate yields of an FCC unit processing a feedstock of the unconverted type from a hydrocracker of a vacuum distillate the standard composition of which is given in Table 3 below, and those of an aromatic complex allowing the recovery of the BTX, without integration of the FCC units and the aromatic complex.

TABLE 3

Characteristics of the cracked FCC feedstock.

| | | FCC Feedstock |
|---|---|---|
| Nitrogen-containing compounds | mg/kg | 7.84 |
| Conradson Carbon | | <0.2% |
| IP (0.50%) | ° C. | 244.1 |
| FP (99.50%) | ° C. | 649.4 |
| Hydrogen (NMR) | % m/m | 14.2 |
| SPGR 15° C. | kg/m3 | 844.8 |
| Saturates | % m/m | 92.1 |
| Aromatics | % m/m | 4.9 |
| Resins | % m/m | 0.7 |
| Vanadium (FX) | mg/kg | <2 |

TABLE 3-continued

| Characteristics of the cracked FCC feedstock. | | |
|---|---|---|
| | | FCC Feedstock |
| Nickel (FX) | mg/kg | <2 |
| Sulphur (FX) | ppm | 54.6 |

The yield structure given in Table 4 was obtained during the high-severity cracking of this standard feedstock:

Riser outlet temperature=607° C., C/O=16.

TABLE 4

| Yield by mass of compound/cut from the cracking of the unconverted hydrocracker effluent. | | | |
|---|---|---|---|
| Compound/Cut | % by weight | Details IP-160° C. | 28.7% by weight |
| C2= | 2.8 | Normal Paraffins | 1.2 |
| C3= | 22.4 | Iso-Paraffins | 6.7 |
| C4= | 23.1 | Naphthenes | 0.6 |
| LCN (IP-160° C.) | 28.7 | Olefins | 16 |
| HCN (160-220° C.) | 3.8 | Di-Olefins | 0.1 |
| Heavy fraction (220+° C.) | 3.3 | Aromatics | 4.1 |
| Coke | 3.1 | C6 Aromatics | 0.6 |
| | | C7 Aromatics | 0.8 |
| | | C8 Aromatics | 2.4 |

In the case of a commercial unit producing 10,000 tons/day of hydrogenated heavy feedstock, the following flow rates were obtained for the main components of interest for petrochemicals:

TABLE 5

| Flow rates of the compounds of interest leaving the FCC. | |
|---|---|
| | Flow rate (tons/day) |
| Ethylene | 280 |
| Propylene | 2240 |
| Butenes | 2310 |
| C6 Aromatic | 60 |
| C7 Aromatic | 80 |
| C8 Aromatic | 240 |
| Coke | 310 |

Under the FCC operating conditions, and with complete combustion in the regenerator, there is found to be a 20% heating power deficit in the regenerator. It is only possible to make up this deficit in an FCC unit by burning a cut of the "torch oil" type or any other type of fuel in the regenerator.

In the case of a commercial gasoline reforming unit which processes 6000 tons/day of a naphtha with an initial point of 85° C. and a final point of 180° C., and in the case of average severity in the reformer giving an RON of 95, the following flow rates of aromatics and exchange flows are obtained with the FCC:

TABLE 6

| Flow rates leaving an aromatic complex processing a flow of reformed gasoline (6000 tons/day in the reformer) | |
|---|---|
| | Flow rate (tons/day) |
| C6 Aromatic | 372 |
| C7 Aromatic | 1134 |
| C8 Aromatic | 1272 |

TABLE 6-continued

| Flow rates leaving an aromatic complex processing a flow of reformed gasoline (6000 tons/day in the reformer) | |
|---|---|
| | Flow rate (tons/day) |
| Heavy aromatics | 426 |
| Raffinate | 1326 |

Example 2

Cracking of a Heavy Aromatic Feedstock Originating from an Aromatic Complex in Addition to the Highly Hydrogenated Heavy Feedstock Under the same operating conditions as for Example 1, Example 2 utilizes the synergies between the FCC and the aromatic complex according to the diagram of FIG. 1, by sending to the reaction section of the FCC, the heavy aromatics feedstock (11) which is an aromatic compounds (CA) effluent, the initial distillation point of which (5%) is approximately 190° C.

This heavy aromatics feedstock (11) is composed 100% of aromatics; the majority (70% m/m) are compounds with 11 or 12 carbon atoms; the remaining 30% by weight are aromatics with 10 carbon atoms.

The processing of this secondary feedstock is carried out in a mixture with the main FCC feedstock defined in Example 1.

The main effluents are then the following:

TABLE 7

| Outlet flow rates of the compounds of interest after integration of the FCC with the aromatic complex. | |
|---|---|
| | Flow rate (tons/day) |
| Ethylene | 285 |
| Propylene | 2245 |
| Butenes | 2312 |
| C6 Aromatic | 476 |
| C7 Aromatic | 1287 |
| C8 Aromatic | 1535 |
| Coke | 384 |

The production of coke for the FCC is thus improved, and with the increase in the FCC feedstock inlet temperature, the heat balance of the FCC is achieved correctly, whereas Example 1 showed a 20% deficit in the heat balance of the FCC unit.

For the aromatic complex (CA), the production of aromatics is significantly improved due to the LCN feedstock originating from the FCC.

The BTX yields of respectively 28% (benzene), 13% (toluene) and 21% (xylenes) are thus improved with respect to a unit without an FCC nearby.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for production of light olefins and a benzene, toluene, and xylene fraction from a first feedstock and a second feedstock, wherein said first feedstock is hydrotreated vacuum gas oil, unconverted oil resulting from hydrocracking, or any mixture of hydrotreated vacuum gas oil and unconverted oil resulting from hydrocracking, and wherein said second feedstock is a naphtha-type feedstock with an initial boiling point greater than 30° C. and final boiling point less than 220° C., said process comprising:

sending said first feedstock to a catalytic cracking unit wherein effluents (6) are produced, and sending said effluents to a fractionation unit, from which a light fraction (8), a light cracked naphtha cut, a heavy cracked gasoline cut, and a heavy fraction having an initial boiling point of 220° C. are extracted, introducing said light fraction (8) into a separation box to separate said light fraction into light olefins, ethylene and propylene, dry gases, and C2, C3 and C4 light paraffins, sending said second feedstock to a catalytic reforming unit wherein catalytic reforming effluents (5) are produced, mixing said light cracked naphtha cut with said catalytic reforming effluents (5) to form a feedstock mixture (10) and introducing said feedstock mixture into an aromatic complex unit, recycling said heavy fraction with an initial boiling point greater than 220° C. to the catalytic cracking unit, extracting the following effluents from the aromatic complex unit: said benzene, toluene, and xylenes fraction, a raffinate (12) defined as the non-aromatic part of the effluents of the aromatic complex unit, and a heavy aromatics fraction, and combining at least a portion of said raffinate and at least a portion of said heavy aromatic fraction with said first feedstock before said first feedstock is sent to said catalytic cracking unit, wherein said catalytic cracking unit operates under the following conditions:

a riser outlet temperature of between 500° C. and 650° C., a catalyst to feedstock ratio of between 5 and 30, and the catalyst used in the catalytic cracking unit is a zeolite with added ZSM-5.

2. The process according to claim 1, wherein said raffinate effluent (12) from the aromatic complex is sent into a separation unit to separate said raffinate effluent into a light fraction (13) and a heavy fraction (14), and said light fraction separated from said raffinate effluent is the portion of said raffinate that is combined with said first feedstock (2) before said first feedstock is sent to the catalytic cracking unit, said heavy fraction (14) is combined with said second feedstock (4) before said second feedstock is sent to said catalytic reforming unit.

3. The process according to claim 1, wherein light C4 and C5 olefins originating from the separation box are sent into an oligomerization unit (16), and effluents from said oligomerization unit (16) are combined with said first feedstock (2) before said first feedstock is sent to said catalytic cracking unit.

4. The process according to claim 1, wherein said first feedstock (2) is preheated in a convection zone of said catalytic reforming unit before said first feedstock is introduced into said catalytic cracking unit.

5. The process according to claim 1, wherein said light cracked naphtha cut has an initial boiling point of from 30° C. to 60° C., and a final boiling point of from 150° C. to 170° C.

6. The process according to claim 1, wherein said heavy aromatics fraction (11) contains aromatics with more than 10 carbon atoms.

7. The process according to claim 1, wherein said first feedstock is obtained from hydroconversion of a vacuum distillate having an initial boiling point of greater than 340° C. and a final boiling point of less than 700° C.

8. The process according to claim 1, wherein said second feedstock is obtained from hydrotreatment (HDT) of a naphtha feedstock having an initial boiling point of greater than 30° C. and a final boiling point of less than 220° C.

9. The process according to claim 1, wherein said second feedstock has an S content of less than 0.5 ppm.

10. The process according to claim 1, wherein said heavy cracked gasoline cut has an initial boiling point corresponding to the final boiling point of the light cracked naphtha cut and a final boiling point not exceeding 220° C.

11. The process according to claim 1, wherein said heavy aromatics fraction (11) has an initial boiling point greater than 190° C.

12. The process according to claim 1, wherein said raffinate (12) from said aromatic complex unit has an initial boiling point of greater than 30° C. and a final boiling point between 150° C. and 220° C.

* * * * *